US006901857B2

(12) United States Patent
Tezenas du Montcel

(10) Patent No.: US 6,901,857 B2
(45) Date of Patent: Jun. 7, 2005

(54) ASSEMBLY COMPRISING A BLANKET UNIT AND A CYLINDER HAVING A BLANKET FIXING DEVICE, A CORRESPONDING CYLINDER, BLANKET UNIT AND OFFSET PRINTING MACHINE

(75) Inventor: Etienne Tezenas du Montcel, Lambearsart (FR)

(73) Assignee: Goss Systemes Graphiques Nantes, Nantes (FR)

( * ) Notice: Subject to any disclaimer, the term of this patent is extended or adjusted under 35 U.S.C. 154(b) by 0 days.

(21) Appl. No.: 10/666,210

(22) Filed: Sep. 18, 2003

(65) Prior Publication Data

US 2004/0216629 A1 Nov. 4, 2004

(30) Foreign Application Priority Data

Sep. 19, 2002 (FR) ..... 02 11620

(51) Int. Cl.[7] ..... B41F 27/12
(52) U.S. Cl. ..... 101/415.1; 101/375; 101/401.1
(58) Field of Search ..... 101/401.1, 382.1, 101/383, 415.1, 378, 375, 376, 217

(56) References Cited

U.S. PATENT DOCUMENTS 5,613,440 A * 3/1997 Rau ..... 101/415.1
5,644,984 A * 7/1997 Puschnerat et al. ..... 101/409
5,687,648 A 11/1997 Puschnerat et al. ..... 101/415.1
5,692,443 A * 12/1997 Reutter ..... 101/415.1
5,809,890 A 9/1998 Knauer et al. ..... 101/415.1
6,101,942 A 8/2000 Robert ..... 101/415.1
6,481,348 B2 * 11/2002 Yoshizawa et al. ..... 101/415.1
6,561,094 B1 * 5/2003 Schneider et al. ..... 101/415.1
6,612,239 B2 * 9/2003 Reichel et al. ..... 101/415.1

FOREIGN PATENT DOCUMENTS

| | | | |
|---|---|---|---|
| DE | 100 60 171 C1 | | 5/2002 |
| EP | 1 172 207 A1 | | 1/2002 |
| FR | 2573347 | | 5/1986 |
| FR | 2733719 | | 11/1996 |
| FR | 2745524 | | 9/1997 |
| GB | 2 167 011 A | * | 5/1986 |
| WO | WO 98/16388 | | 4/1998 |

* cited by examiner

*Primary Examiner*—Leslie J. Evanisko
(74) *Attorney, Agent, or Firm*—Marshall, Gerstein & Borun LLP

(57) ABSTRACT

An assembly for an offset printing machine having a blanket unit comprising a blanket and a blanket support plate, the front edge and rear edge of the support plate being bent over and extending beyond the front edge and rear edge of the blanket, and a cylinder having an aperture for receiving the front edge and rear edge of the support plate, the cylinder comprising a device for fixing the blanket unit to the cylinder, the fixing device comprising at least one hook for tensioning the blanket unit.

17 Claims, 8 Drawing Sheets

ASSEMBLY COMPRISING A BLANKET UNIT AND A CYLINDER HAVING A BLANKET FIXING DEVICE, A CORRESPONDING CYLINDER, BLANKET UNIT AND OFFSET PRINTING MACHINE

TECHNICAL FIELD

The present invention relates to an assembly for an offset printing machine comprising:

a blanket unit comprising a blanket and a blanket support plate, the front edge and rear edge of the support plate being bent over in the region of a front bend and a rear bend, respectively, the rear edge of the support plate protruding beyond the rear edge of the blanket which is located adjacent to the rear bend, and a cylinder having an aperture for receiving the front edge and rear edge of the support plate, the cylinder comprising a device for fixing the blanket unit to the cylinder, the fixing device comprising at least one hook for tensioning the blanket unit, the hook being intended to be received in an opening of the rear edge of the support plate, which rear edge is inserted into the aperture, in order to apply to the support plate a tension load which is substantially parallel with the rear edge thereof.

BACKGROUND TO THE INVENTION

A printing machine of this type conventionally comprises, in addition to the blanket-carrying cylinder and the blanket, a plate-carrying cylinder and a plate and a pressing cylinder.

During operation, the plate carried by the plate-carrying cylinder is moistened then inked. The plate transfers the ink from the printing regions thereof to the blanket carried by the blanket-carrying cylinder. The blanket then transfers the ink to the paper to be printed which passes between the blanket-carrying cylinder and the pressing cylinder.

In order to tension the blanket on the cylinder, metal bars crimped to the ends of the blanket were traditionally used. These bars were engaged in the aperture of the cylinder, where they were pushed by a screw-type device.

Such arrangements lead to aperture widths which are very large, reaching 22 mm.

The presence of such large apertures results in shocks and vibrations when the blanket-carrying cylinder rotates against the plate-carrying cylinder and against the pressing cylinder. Such vibrations limit the rotation speeds of the various cylinders and therefore the production capacities of offset printing machines.

FR-2 573 347 proposed an assembly of the above-mentioned type. The front edge of the blanket covers all the front edge of the support plate and therefore extends into the cylinder aperture. The rear edge of the blanket does not extend into the aperture and is applied substantially against the region of the front bend of the blanket unit. In this manner, the gap between the start of the blanket and the end of the blanket is extremely narrow in order to limit the vibrations which result from the presence of the aperture in the cylinder.

However, it was found that it was extremely difficult to bend the front edge of the plate and the front edge of the blanket in order to obtain the configuration desired in this document.

FR-2 733 719 proposed another solution in which the device for fixing the blanket unit comprises pressing studs which apply the front and rear edges of the support plate against the front wall of the aperture. These front and rear edges of the support plate are not covered by the blanket. The forces applied by the studs are exclusively perpendicular to the front and rear edges of the support plate.

It was found that this arrangement did not allow the blanket unit to be tensioned satisfactorily. In addition, the fixing device described does not allow the deformations of the blanket unit resulting from the operation of the offset printing machine to be absorbed. In particular, the expansions of the support plate cannot be absorbed so that cracks in the plate adjacent to the rear bend thereof are observed.

FR-2 745 524 proposed that the pressing studs be replaced with one or more resilient blades. However, this arrangement does not always allow satisfactory tension of the blanket unit to be obtained.

An object of the invention is to provide an assembly of the above-mentioned type which allows the blanket unit to be tensioned on and fixed to the cylinder in a satisfactory manner and which is simple and economical to produce.

SUMMARY OF THE INVENTION

To this end, the invention relates to an assembly of the above-mentioned type, characterised in that the front edge of the support plate protrudes beyond the front edge of the blanket which is located adjacent to the front bend.

According to particular embodiments, the assembly can comprise one or more of the following features, taken in isolation or according to all technically possible combinations:

the opening is provided in a region of the rear edge of the support plate forming an angle which is not equal to zero with the front edge of the support plate, the hook comprises a resilient blade, the assembly comprises means for applying the front edge of the support plate against the front wall of the aperture, these application means being separate from the hook, the application means comprise at least one element for pressing on the front edge of the support plate, the pressing element belonging to the fixing device and being separate from the support plate, the pressing element extends, in order to press on the front edge of the support plate, through the opening which receives the hook, the pressing element comprises a resilient blade, the rear edge of the support plate is itself bent in the region of an intermediate bend which delimits an end region, in which the opening for receiving the hook is provided, and an intermediate region which is intended to press against the front edge of the support plate and which thereby forms the application means, the aperture has a width, near the peripheral surface of the cylinder, of less than 1.5 mm, the width of the aperture is less than 1.1 mm, the front and rear walls of the aperture form, starting from the peripheral surface of the cylinder, an angle which is less than 20°.

The invention also relates to a cylinder for an assembly as defined above.

According to one variant, the fixing device comprises at least one element for pressing on the front edge of the support plate in order to apply it against the front wall of the aperture, the pressing element being separate from the hook.

The invention further relates to a blanket unit for an assembly as defined above.

According to one variant, the rear edge of the support plate is itself bent in the region of an intermediate bend which delimits an end region, in which the opening for receiving the hook is provided, and an intermediate region which is intended to press against the front edge of the support plate in order to apply it against the front wall of the aperture.

The invention also relates to an offset printing machine comprising an assembly as defined above.

BRIEF DESCRIPTION OF DRAWINGS

The invention will be better appreciated from the description below which is given purely by way of example with reference to the appended drawings, in which.

DESCRIPTION OF PREFERRED EMBODIMENT

Figure 1:
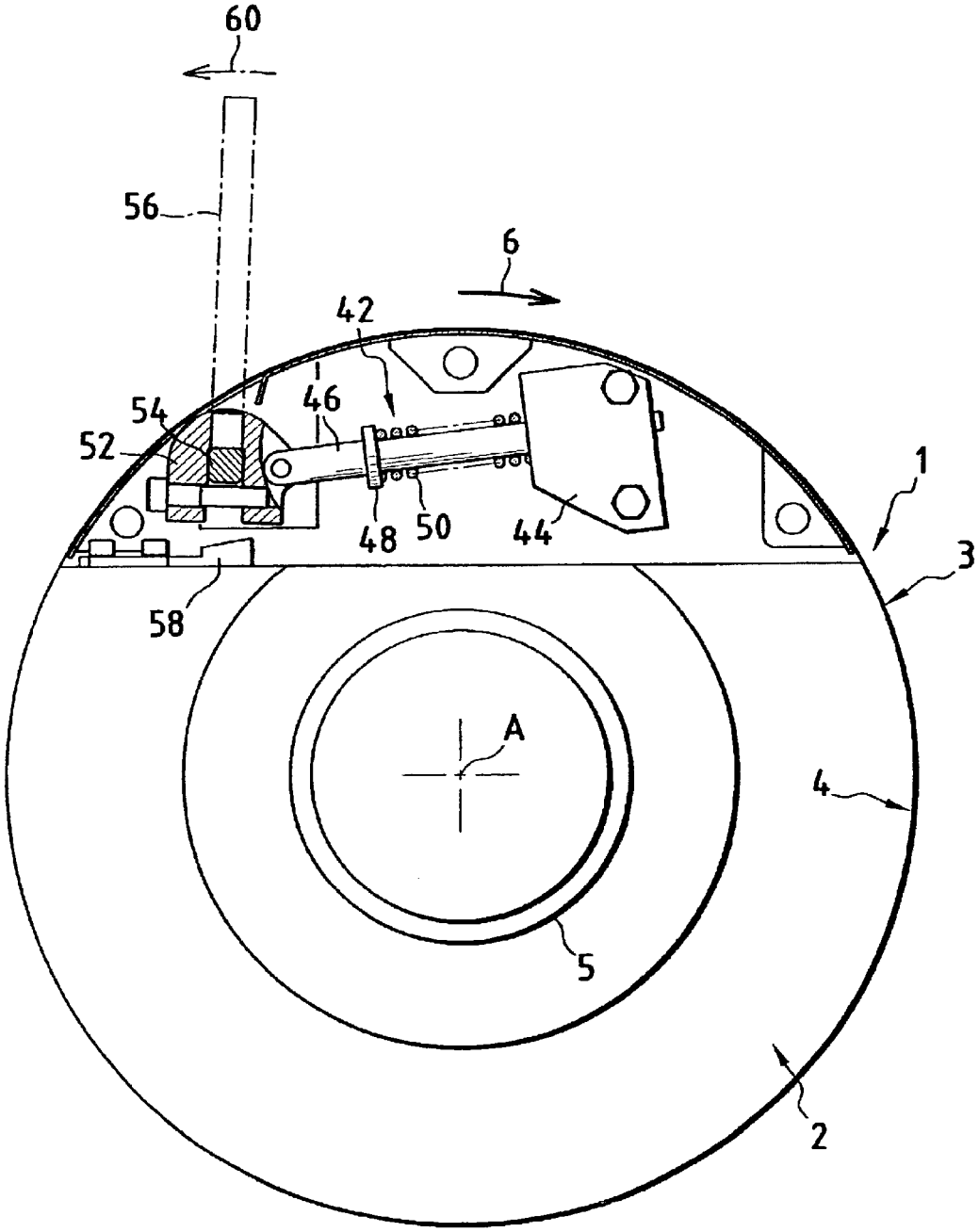
FIG. 1 is a schematic side view of an assembly according to a first embodiment of the invention.

FIG. 1 illustrates schematically an assembly 1 for an offset printing machine which comprises a cylinder 2 and a blanket unit 3 which surrounds the peripheral surface 4 of the cylinder 2 and which is carried by the cylinder 2.

The cylinder 2 extends along a longitudinal axis A and the longitudinal ends 5 thereof, only one of which is visible in FIG. 1, are intended to be received in bearings of the support structure of an offset printing machine. In this manner, the cylinder 2 can, owing to conventional driving means which are not illustrated, rotate about the longitudinal axis A thereof in a sense illustrated by the arrow 6 in FIG. 1.

Hereinafter, the terms "front" and "rear" used should be understood with reference to this sense of rotation 6.

Figure 2:
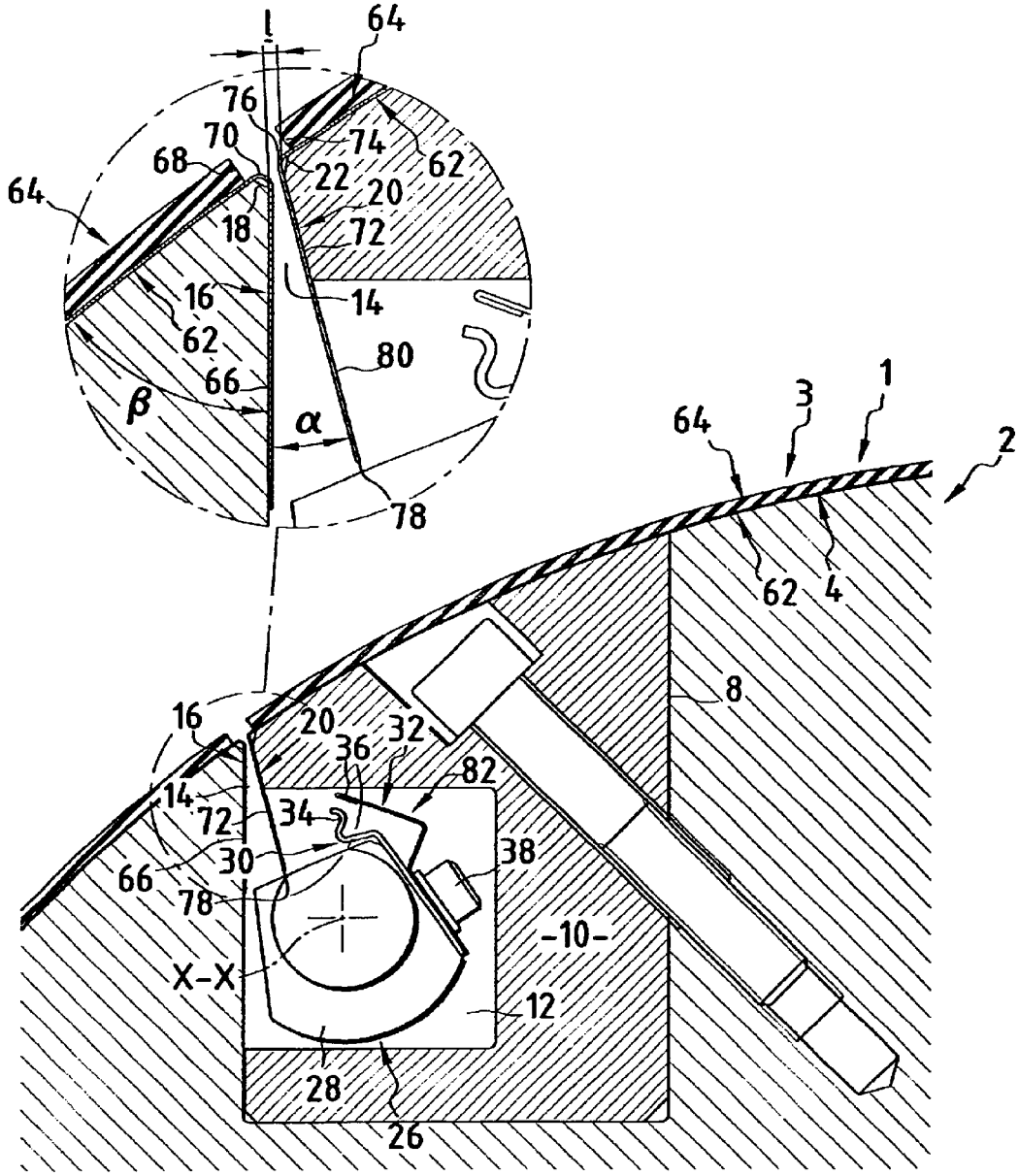
FIG. 2 is a schematic partial cross-section, drawn to an enlarged scale, illustrating the fixing device of the blanket unit of the assembly of FIG. 1.

As is visible in FIG. 2, a longitudinal recess 8 has been provided in the cylinder 2 from the peripheral surface 4 thereof. This recess 8 is substantially in the form of a regular trapezium in cross-section with one rounded side corresponding to a portion of the peripheral surface 4 of the cylinder 2.

An insert 10 is screwed into the recess 8.

This insert 10 delimits inside the cylinder 2 a longitudinal cavity 12 having a substantially rectangular cross-section and a longitudinal aperture 14 having a substantially triangular cross-section.

The aperture 14 opens into the peripheral surface 4 of the cylinder 2 and into the cavity 12.

As illustrated in greater detail by the enlarged circled portion of FIG. 2, the front wall 16, which is common to the aperture 14 and the cavity 12, is connected to the peripheral surface 4 by a chamfer 18, for example, having a width of approximately 1 mm.

Similarly, the rear wall 20 of the aperture 14 is connected by a chamfer 22 to the peripheral surface 4. This chamfer 22 has, for example, a width of approximately 1.4 mm.

The front wall 16 and rear wall 20 of the aperture 14 diverge as they approach the cavity 12, that is to say, from an upstream point towards a downstream point of the aperture 14. The walls 16 and 20 thus form between them an angle $\alpha$ which is typically approximately 14.8°. More generally, this angle a will be less than 20°.

The upstream width 1 of the aperture 14 between the walls 16 and 20, that is to say, downstream of the chamfers 18 and 22 is approximately 1 mm. More generally, this width 1 will be less than 1.5 mm, and preferably less than 1.1 mm.

The cylinder 2 comprises a device 26 for fixing the blanket unit 3 to the cylinder 2. This device 26 is arranged in the cavity 12 and comprises a spindle 28 which extends along an axis X—X which is substantially parallel with axis A of the cylinder 2. This spindle 28 extends, for example, all the way along the cylinder 2.

Figure 3:
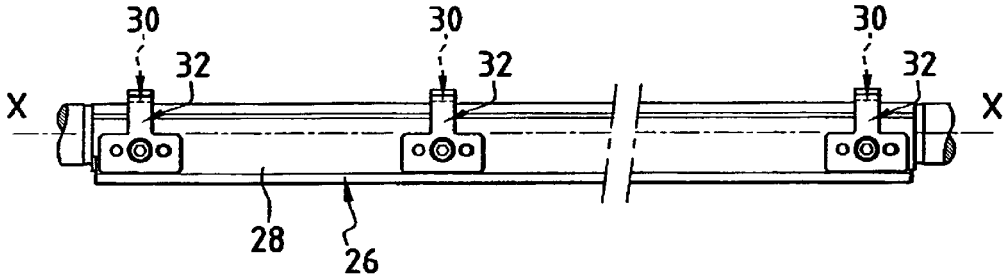
FIG. 3 is a schematic partial top view, illustrating part of the spindle of the fixing device of FIG. 2.

As illustrated by FIGS. 2 and 3, hooks 30 and pressing elements 32 are distributed along the spindle 28.

The hooks 30 are formed by resilient blades whose free ends 34 are curved opposite the aperture 14.

Similarly, the pressing elements 32 are formed by resilient blades whose free ends 36 are bent through 180°.

The hooks 30 and the pressing elements 32 are associated in pairs, the associated hook 30 and pressing element 32 being fixed to the spindle 28 by a common screw 38. The pressing element 32 is arranged above the associated hook 30.

The pairs comprising a hook 30 and pressing element 32 are spaced apart from each other longitudinally and distributed along the spindle 28.

The spindle 28 is mounted so as to be able to rotate about longitudinal axis X—X thereof in the cavity 12 owing to, for example, bearings provided at the ends of the spindle 28 and optionally in intermediate regions thereof.

Figure 6:
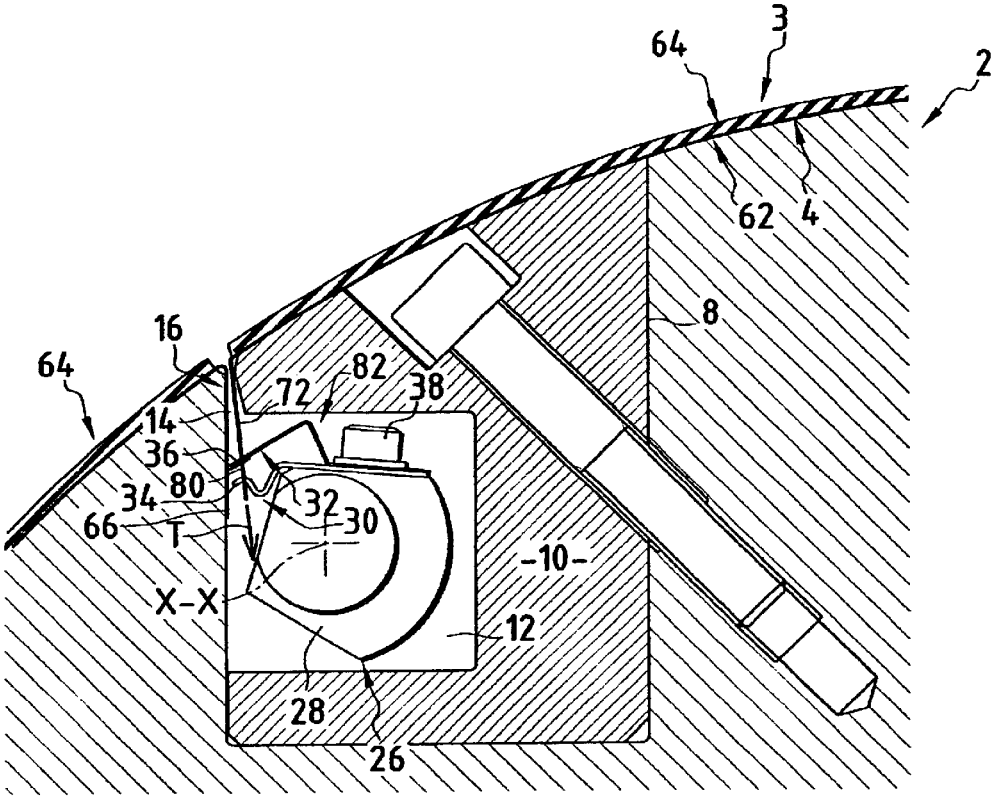

In this manner, the spindle 28 can move between two positions illustrated by FIGS. 2 and 6, respectively.

In the position of FIG. 2, or the release position of the blanket unit 3, the hooks 30 and the pressing elements 32 are moved away from the aperture 14 and free up the access to the cavity 12.

In the position of FIG. 6 or the fixing position of the blanket unit 3, the hooks 30 and the pressing elements 32 are moved towards the front wall 16.

In order to move from the position of FIG. 2 into the position of FIG. 6, the spindle 28 pivots in the counterclockwise sense, as seen in these Figures. This pivoting can be brought about by drive mechanisms 42, only one of which is visible in FIG. 1, the other having a similar structure and being arranged at the other side of the cylinder 2. Thus, only the mechanism 42 visible in FIG. 1 will be described below.

The drive mechanism 42 can comprise, for example:

- a support 44 fixed to a flank of the cylinder,
- a rod 46 which is provided with a collar 48 and which is surrounded by a spring 50,
- a block 52 which is fixed to the corresponding longitudinal end 54 of the spindle 28, and
- a moveable operating lever 56, which is illustrated as a dot-dash line in FIG. 1.

The rod 46 is articulated to the block 52 at a first end thereof. The rod 46 is mounted, at the other end thereof, in the support 44 by means of an articulation which allows it to pivot in a plane at right-angles to axis A of the cylinder 2. The spring 50 presses, on the one hand, on the block 44 and, on the other, on the collar 48.

Owing to the lever 56, the rod 46 can move relative to the support 44 between two stable end positions.

The first stable end position is illustrated in FIG. 1, This position corresponds to the release position of the spindle 28, illustrated in FIG. 2.

Figure 7:
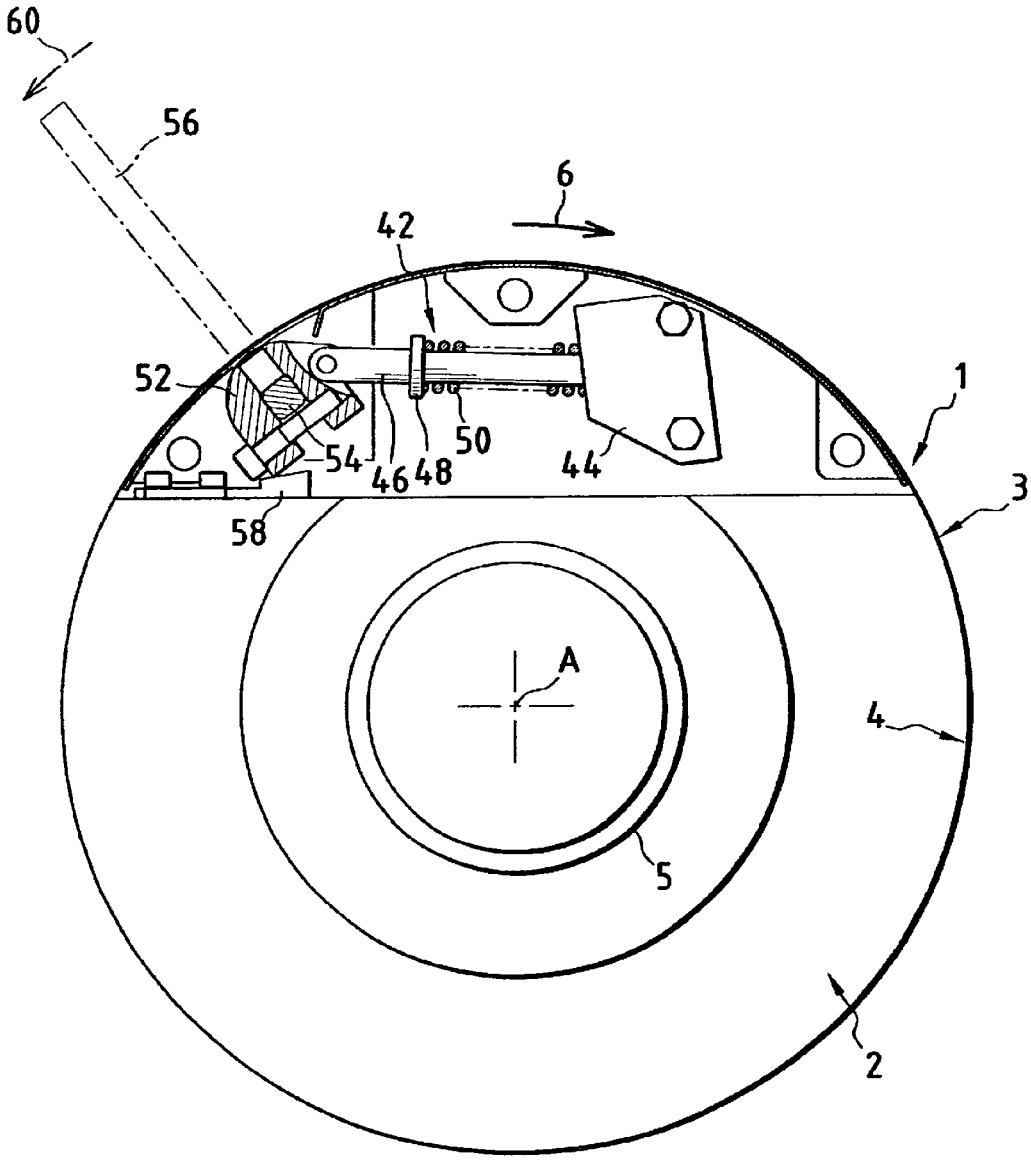
FIG. 7 is a view similar to FIG. 1, illustrating the position of a drive mechanism of the fixing device at the end of the fixing of the blanket unit.

The second stable end position is illustrated in FIG. 7. In this position, the spindle 28 is in the fixing position illustrated in FIG. 6.

In order to move from the position in FIG. 1 to that in FIG. 7, an operator pivots the lever 56 in the counter-clockwise sense, as illustrated by the arrow 60 in FIG. 1.

The rod 46 will then move through an unstable neutral position, where the axis thereof will intersect with axis X—X of the spindle 28. The spring 50 is then compressed so that it will return the rod 46 towards the second stable position thereof, that is to say, the position of FIG. 7. The block 52 is then pressed against an adjustable stop 58 which allows the angular position of the spindle 28 in the fixing position thereof to be adjusted.

In this manner, the mechanism 42 for passing through the neutral position allows the spindle 28 to be displaced manually from the release position thereof towards the fixing position thereof, and vice versa. However, it should be noted that any other type of drive mechanism 42 can be used.

With reference once more to FIG. 2 it will be appreciated that the blanket unit 3 comprises a support plate 62 and a blanket 64 which is fixed to the support plate 62.

The support plate 62 is produced, for example, from stainless steel. Its thickness is approximately 0.2 mm.

The blanket 64 conventionally comprises, for example, a plurality of layers of elastomer and fabric. The blanket 64 is fixed to the support plate 62 by adhesive bonding or vulcanisation.

The front edge 66 of the support plate 62 extends beyond the front edge 68 of the blanket 64. The front edge 66 of the support plate 62 is bent in the region of a front bend 70 in order to form with the rest of the plate 62 an acute angle β.

The front edge 68 of the blanket 64 is arranged in a slightly withdrawn position relative to the bend 70. In some variants, however, the front edge 68 can be in an advanced position in order to cover at least partially the bend 70. Be that as it may, the front edge 68 will be located adjacent to the bend 70 in order not to extend into the aperture 14.

The front edge 66 of the support plate 62 is not covered by the blanket 64 and is inserted into the aperture 14. The front bend 70 extends over the chamfer 18 and the front edge 66 of the plate 62 extends along the front wall 16 of the aperture 14.

The blanket unit 3 has, at the rear, a configuration similar to the rear edge 72 of the plate 62, which edge 72 is not covered by the rear edge 74 of the blanket 64. The rear edge 72 is bent in the region of a rear bend 76 relative to the rest of the support plate 62, forming an obtuse angle unlike the front of the blanket unit 3.

The bare rear edge 72 is inserted into the aperture 14 and extends along and against the rear wall 20 of the aperture 14.

The rear edge 74 of the blanket 64 is arranged adjacent to the rear bend 22 in order not to extend into the aperture 14 and to be relatively near the front edge 68 of the blanket 64.

The front edge 66 and rear edge 72 of the support plate 62 extend inside the aperture 14 as far as the cavity 12 and together form an angle which is not equal to zero.

Figure 4:
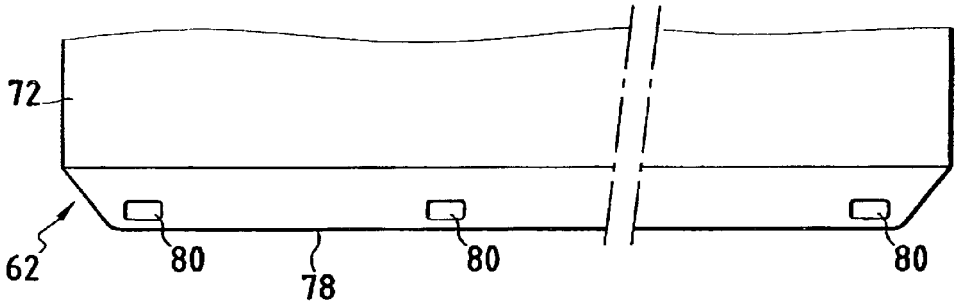
FIG. 4 is a schematic partial view illustrating the rear edge of the support plate of the blanket unit.

As illustrated in FIG. 4, the rear edge 72 of the support plate 62 has, at the free end 78 thereof, a series of openings 80 distributed along the end 78. These openings 80 are substantially of rectangular form and are each arranged facing a pair comprising a hook 30 and pressing element 32.

In order to mount the blanket unit 3 on the cylinder 2, the procedure is, for example, as follows, The spindle 28 being in the release position, the front edge 66 of the support plate 62 is first inserted into the aperture 14, then the blanket unit 3 is wrapped around the cylinder 2 until the rear edge 72 of the support plate 62 is engaged in the aperture 14. The blanket unit 3 is then in the position of FIG. 2.

The spindle 28 is then pivoted, by means of the levers 56 and mechanisms 42, from the release position thereof in FIG. 2, into the fixing position thereof in FIG. 6.

Figure 5:
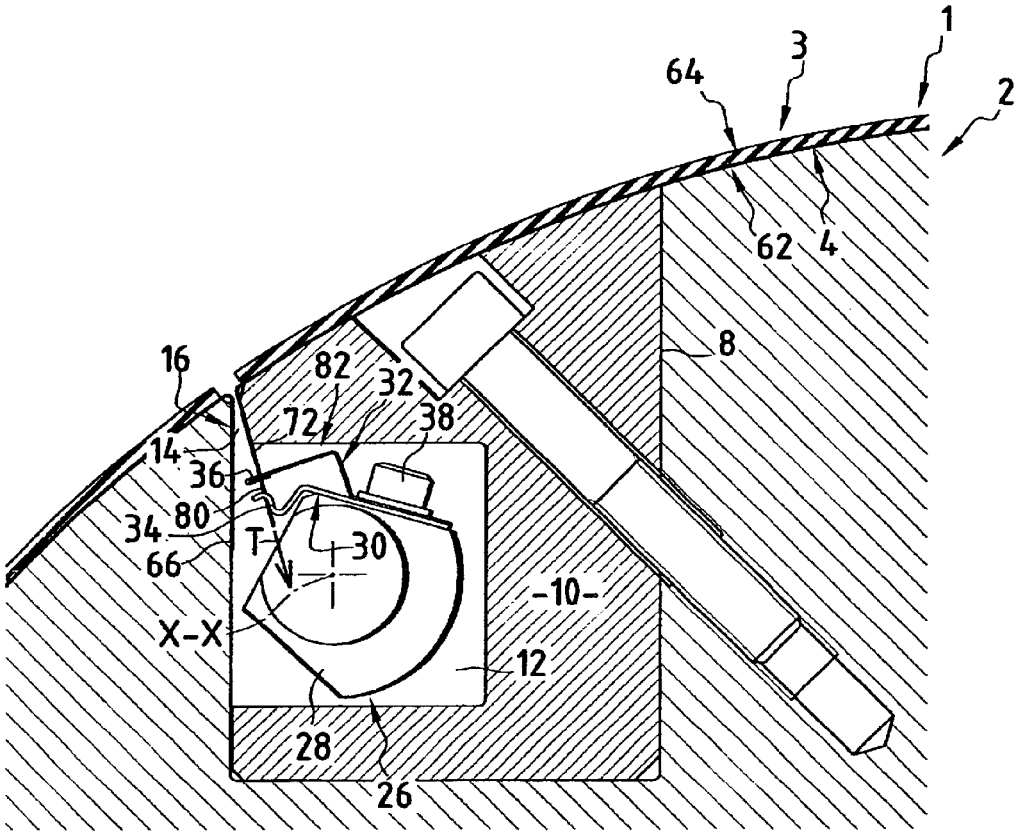
FIGS. 5 and 6 are views similar to FIG. 2, illustrating successive steps in the engagement of the blanket unit with the fixing device.

During this rotation, the free end 34 of each hook 30 engages in the corresponding opening 80 of the rear edge 72 of the support plate 62 and the associated pressing element 32 extends through the same opening 80. This is illustrated in FIG. 5.

As the rotation movement of the spindle 28 continues, each hook 30 which is firmly engaged against the periphery of the corresponding opening 80 progressively brings about the tensioning of the support plate 2, whilst the associated pressing element 32 which extends through the opening 80 will press on the front edge 66 of the support plate 62 and press it against the front wall 16 of the aperture 14 and cavity 12.

It should be noted that each hook 30 applies a tension load T which is substantially parallel with the rear edge 72 to the rear edge 72 of the support plate 62.

Once this movement is complete, the rear edge 72 of the plate 62 is drawn by the hooks 30, thereby ensuring satisfactory tensioning of the blanket 64, and the front edge 66 of the support plate 2 is applied against the front wall 16. It should be noted that the rear edge 72 again forms an angle not equal to zero with the front edge 66 of the support plate 62.

In this manner, the blanket unit 3 is fixed to and tensioned on the cylinder 2 in a satisfactory manner.

In spite of this, the hooks 30 and the pressing elements 32 allow, owing to the construction thereof in the form of resilient elements, slight movements of the edges 66 and 72 of the support plate 2. This allows adaptation to various operating constraints of the offset printing machine and, in particular, to the phenomenon of thermal expansion of the support plate 62 and the phenomenon known as "indention".

In this manner, the rear edge 72 of the support plate 62 can, under the effect of thermal expansion or in the case of the phenomenon known as "indention" extend further into the aperture 14, the hooks 30 allowing this movement whilst keeping the blanket unit 3 under tension.

The pressing elements 32 form means 82 for applying the front edge 66 of the support plate 62 against the wall 16, which means 82 allow the blanket unit 3 to be stabilised on the cylinder 2.

Since these application means 82 are separate from the hooks 30, the stabilisation, fixing and tension of the blanket unit 3 are ensured in a relatively simple manner.

Furthermore, the use of the same openings 80 for receiving the hooks 30 and the pressing elements 32 allows the number of openings in the support plate 62 to be limited.

It should also be noted that the use of openings 80 in the support plate 62 for co-operating with the hooks 30 allows the support plate not to have a curved rear edge, and therefore to keep the width l of the aperture 14 small. The inclination of the rear edge 72 of the support plate 62 relative to the front edge 66 thereof also allows the aperture 14 to have a small upstream width 1.

This width 1 is even smaller because neither the front edge 68 nor the rear edge 74 of the blanket 64 extends into the aperture 14.

This allows the vibrations during the rotation of the various cylinders of the offset printing machine on each other to be greatly limited.

Since the blanket 64 further does not cover all the front edge 66 of the support plate 62, as in FR-2 573 347, the construction of the blanket unit and, in particular, the bending of the support plate are simple and economical, whilst limiting vibrations during operation.

Figure 8:
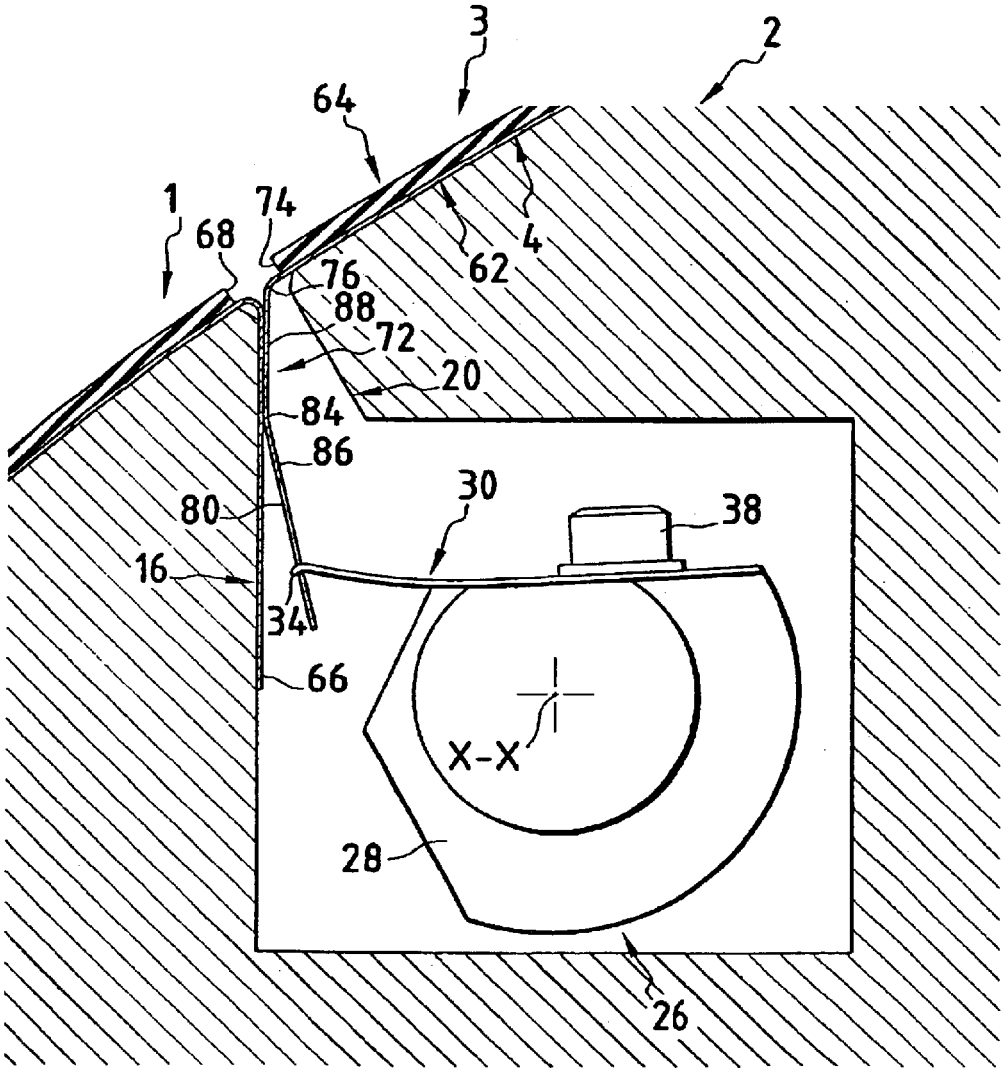
FIG. 8 is a view similar to FIG. 6, illustrating a second embodiment of the invention

In another embodiment illustrated in FIG. 8, the application means 82 are formed, not by pressing elements 32 belonging to the fixing device 26, but instead by a region of the rear edge 72 of the support plate 62.

In this manner, the rear edge 72 has an intermediate bend 84 which delimits, in the rear edge 72, an end region 86, in which the openings 80 for receiving the hooks 30 are provided, and an intermediate region 88 which is bent to a lesser extent relative to the rest of the support plate 62. This intermediate region 88 presses on the front edge 66 of the support plate 62 and applies it against the wall 16.

Figure 9:
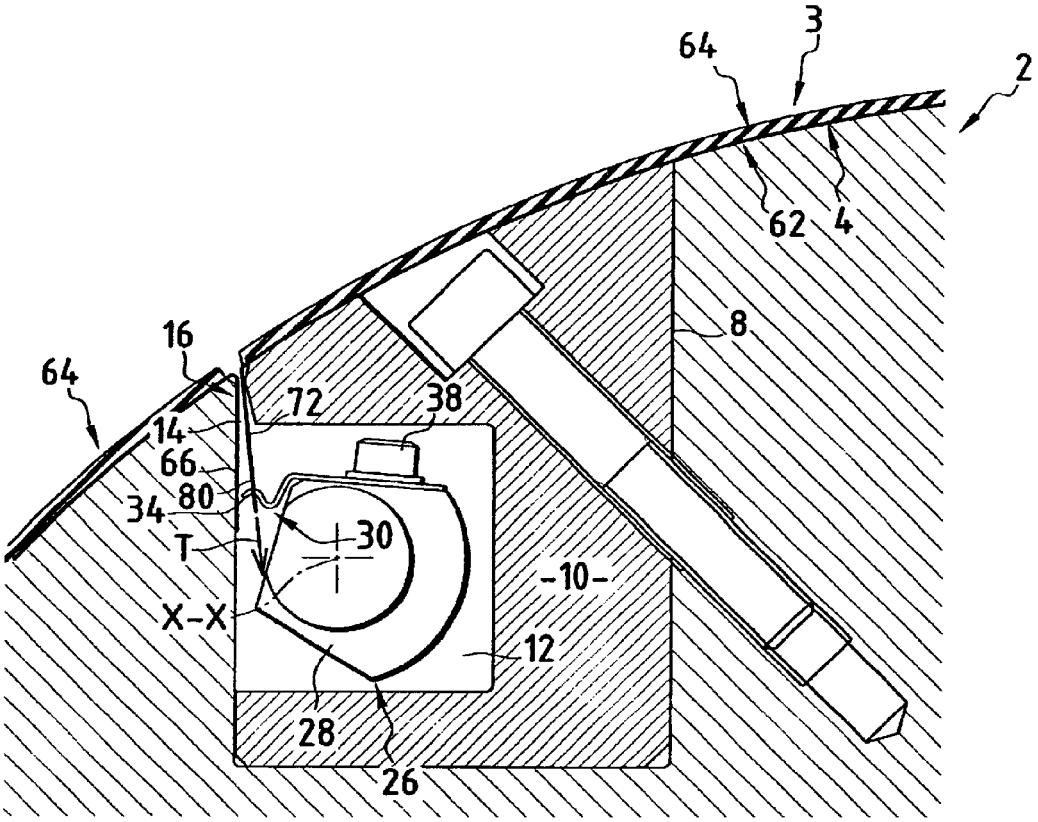
FIG. 9 is a view similar to FIG. 6, further illustrating a third embodiment of the invention.

FIG. 9 relates to a third embodiment which differs from that of FIGS. 1 to 7 in that the means 82 for applying the front edge 66 of the support plate 62 against the wall 16 have been dispensed with.

In spite of the absence of the application means 82, the fixing and tensioning of the blanket unit 3 have been found to be satisfactory.

It should be noted that, in the case of each of the above-described embodiments, the cylinder and the blanket unit can be sold independently of each other.

In general, the above principles can be used with a cylinder 2, to which two blanket units 3 are fixed, one beside the other, along axis A of the cylinder 2.

The fixing devices 42 associated with each blanket unit 3 can be offset angularly from each other relative to axis A, for example, by 180°. In this manner, the apertures 14 associated with each blanket unit 3 are diametrically opposed, which limits the vibrations caused during the rotation against the other cylinders of the printing machine, and do not extend over the entire length of the cylinder 2.

What is claimed is:

1. Assembly for an offset printing machine, comprising:

a blanket unit comprising a blanket and a blanket support plate, the front edge and rear edge of the support plate being bent over in the region of a front bend and a rear bend, respectively, the rear edge of the support plate protruding beyond the rear edge of the blanket which is located adjacent to the rear bend, and a cylinder having an aperture for receiving the front edge and rear edge of the support plate, the cylinder comprising a device for fixing the blanket unit to the cylinder, the fixing device comprising at least one hook for tensioning the blanket unit, the hook being intended to be received in one of at least one openings of the rear edge of the support plate, which rear edge is inserted into the aperture, in order to apply to the support plate a tension load which is substantially parallel with the rear edge thereof, the assembly further comprising, at least one element for pressing on the front edge of the support plate to apply the front edge of the support plate against the front wall of the aperture, the pressing element belonging to the fixing device and being separate from the hook and the support plate, wherein the pressing element extends, in order to press on the front edge of the support plate, through one of the at least one openings.

2. Assembly according to claim 1, wherein the opening is provided in a region of the rear edge of the support plate forming an angle which is not equal to zero with the front edge of the support plate.

3. Assembly according to claim 1, wherein the hook comprises a resilient blade.

4. Assembly according to claim 1, wherein the pressing element comprises a resilient blade.

5. Assembly according to claim 1, wherein the aperture has a width, near the peripheral surface of the cylinder, of less than 1.5 mm.

6. Assembly according to claim 5, wherein the width of the aperture is less than 1.1 mm.

7. Assembly for an offset printing machine, comprising:

a blanket unit comprising a blanket and a blanket support plate, the front edge and rear edge of the support plate being bent over in the region of a front bend and a rear bend, respectively, the rear edge of the support plate protruding beyond the rear edge of the blanket which is located adjacent to the rear bend, and a cylinder having an aperture for receiving the front edge and rear edge of the support plate, the cylinder comprising a device for fixing the blanket unit to the cylinder, the fixing device comprising at least one hook for tensioning the blanket unit, the hook being intended to be received in an opening of the rear edge of the support plate, which rear edge is inserted into the aperture, in order to apply to the support plate a tension load which is substantially parallel with the rear edge thereof, wherein the front edge of the support plate protrudes beyond the front edge of the blanket which is located adjacent to the front bend, the assembly further comprising means for applying the front edge of the support plate against the front wall of the aperture, these application means being separate from the hook, and wherein the rear edge of the support plate is itself bent in the region of an intermediate bend which delimits an end region, in which the opening for receiving the hook is provided, and an intermediate region which is intended to press against the front edge of the support plate and which thereby forms the application means.

8. Assembly according to claim 7, wherein the opening is provided in a region of the rear edge of the support plate forming an angle which is not equal to zero with the front edge of the support plate.

9. Assembly according to claim 7, wherein the book comprises a resilient blade.

10. Assembly according to claim 7, wherein the aperture has a width, near the peripheral surface of the cylinder, of less than 1.5 mm.

11. Assembly according to claim 10, wherein the width of the aperture is less than 1.1 mm.

12. Assembly for an offset printing machine, comprising:

a blanket unit comprising a blanket and a blanket support plate, the front edge and rear edge of the support elate being bent over in the region of a front bend and a rear bend, respectively, the rear edge of the support plate protruding beyond the rear edge of the blanket which is located adjacent to the rear bend, and a cylinder having an aperture for receiving the front edge and rear edge of the support plate, the cylinder comprising a device for fixing the blanket unit to the cylinder, the flexing device comprising at least one hook for tensioning the blanket unit, the hook being intended to be received in an opening of the rear edge of the support plate, which rear edge is inserted into the aperture, in order to apply to the support plate a tension load which is substantially parallel with the rear edge thereof, wherein the front edge of the support plate protrudes beyond the front edge of the blanket which is located adjacent to the front bend, and wherein the front wall and rear wall of the aperture form, starting from the peripheral surface of the cylinder, an angle which is less than 20°.

13. Assembly according to claim 12, wherein the opening is provided in a region of the rear edge of the support plate forming an angle which is not equal to zero with the front edge of the support plate.

14. Assembly according to claim 12, wherein the hook comprises a resilient blade.

15. Assembly according to claim 12, wherein the aperture has a width, near the peripheral surface of the cylinder, of less than 1.5 mm.

16. Assembly according to claim 15, wherein the width of the aperture is less than 1.1 mm.

17. Blanket unit for an offset printing machine, the blanket unit comprising a blanket and a blanket support plate, the front edge and rear edge of the support plate being bent over in the region of a front bend and a rear bend, respectively, the rear edge of the support plate protruding beyond the rear edge of the blanket which is located adjacent to the rear bend, and the offset printing machine comprising a cylinder having an aperture for receiving the front edge and rear edge of the support plate, the cylinder comprising a device for fixing the blanket unit to the cylinder, the fixing device comprising at least one hook for tensioning the blanket unit, the hook being intended to be received in an opening of the rear edge of the support plate, which rear edge is inserted into the aperture, in order to apply to the support plate a tension load which is substantially parallel with the rear edge thereof, wherein the rear edge of the support plate is bent in the region of an intermediate bend which delimits an end region, in which the opening for receiving the hook is provided, and an intermediate region which is intended to press against the front edge of the support plate in order to apply the front edge of the support plate against the front wall of the aperture.

* * * * *

UNITED STATES PATENT AND TRADEMARK OFFICE

CERTIFICATE OF CORRECTION

PATENT NO. : 6,901,857 B2
DATED : June 7, 2005
INVENTOR(S) : Etienne T. Du Montcel It is certified that error appears in the above-identified patent and that said Letters Patent is hereby corrected as shown below:

Column 8,
Line 41, “is itself bent” should be -- is bent --;
Line 51, “book” should be -- hook --;
Line 60, “elate” should be -- plate -- ; and Column 9,
Line 2, “flexing” should be -- fixing --.

Signed and Sealed this

Twentieth Day of September, 2005

JON W. DUDAS
*Director of the United States Patent and Trademark Office*